US006786850B2

(12) United States Patent
Nizamuddin

(10) Patent No.: US 6,786,850 B2
(45) Date of Patent: Sep. 7, 2004

(54) EXERCISE APPARATUS FOR SIMULATING SKATING MOVEMENT

(75) Inventor: Nash Nizamuddin, Thornhill (CA)

(73) Assignee: Skatestrider Inc., Thornhill (CA)

( * ) Notice: Subject to any disclaimer, the term of this patent is extended or adjusted under 35 U.S.C. 154(b) by 245 days.

(21) Appl. No.: 09/909,020

(22) Filed: Jul. 20, 2001

(65) Prior Publication Data

US 2002/0042329 A1 Apr. 11, 2002

Related U.S. Application Data

(60) Provisional application No. 60/237,387, filed on Oct. 4, 2000.

(51) Int. Cl.[7] ..... A63B 22/00; A63B 69/18

(52) U.S. Cl. ..... 482/51; 482/70

(58) Field of Search ..... 482/51–53, 70–71, 482/148; 434/253

(56) References Cited

U.S. PATENT DOCUMENTS

| | | | | |
|---|---|---|---|---|
| 4,340,214 A | | 7/1982 | Schutzer | |
| 4,744,557 A | | 5/1988 | Smirmaul | |
| 4,781,372 A | | 11/1988 | McCormack | |
| 4,811,941 A | | 3/1989 | Elo | |
| 4,869,496 A | | 9/1989 | Colombo | |
| 4,911,430 A | | 3/1990 | Flament | |
| 4,915,373 A | | 4/1990 | Walker | |
| 5,222,928 A | * | 6/1993 | Yacullo | 482/71 |
| 5,279,532 A | * | 1/1994 | Chen | 482/71 |
| 5,284,460 A | | 2/1994 | Miller et al. | |
| 5,328,427 A | * | 7/1994 | Sleamaker | 482/71 |
| 5,503,609 A | | 4/1996 | Bull | |
| 5,520,598 A | * | 5/1996 | Little | 482/79 |
| 5,637,060 A | | 6/1997 | de Souza | |
| 5,643,153 A | | 7/1997 | Nylen et al. | |
| 5,713,794 A | | 2/1998 | Shimojima et al. | |
| 5,718,658 A | | 2/1998 | Miller et al. | |
| 6,234,935 B1 | | 5/2001 | Chu | |

* cited by examiner

*Primary Examiner*—Jerome W. Donnelly
*Assistant Examiner*—Fenn Mathew

(57) ABSTRACT

An exercise apparatus used to simulate skating or roller blading movement in a user includes a pair of sleds or shuttles which include a pedal adapted to support the foot of a user standing thereon. The shuttles are movable along a respective guide assembly consisting of one or more rails which curve away from each other extending from proximate forwardmost ends, outwardly and rearwardly. The rail assemblies are provided in a substantially mirror arrangement and curve downwardly from their respective forwardmost ends to a lowermost distal portion. A guide member is provided to assist in positioning and maintaining the shuttles in sliding movement along each guide assembly, whereby the reciprocal sliding movement of the shuttles along an associated guide assembly acts to guide the feet of the user in skating or roller blade movement.

20 Claims, 7 Drawing Sheets

EXERCISE APPARATUS FOR SIMULATING SKATING MOVEMENT

RELATED APPLICATIONS

This application claims the benefit under 35 U.S.C. 119(e) to U.S. provisional application Ser. No. 60/237,387 filed Oct. 4, 2000.

SCOPE OF THE INVENTION

The present invention relates to an exercise apparatus, and more particularly, an apparatus which in use is adapted to simulate an athlete's natural skating or roller blading movement, whereby the user's legs travel simultaneously in a lateral and rearward motion.

BACKGROUND OF THE INVENTION

Exercise apparatus which simulate walking, running and stair climbing are well known. Running and walking exercise apparatus typically comprise an inclined moving belt or treadmill upon which the user walks or runs. Stair climbing or stepping apparatus typically include a pair of hinged pedals upon which a user stands, and in which the pedals are moved up and down by the user shifting his or her weight to simulate stair climbing movement. While conventional exercise apparatus achieve the exercise and movement of the biceps femoris muscle, they are poorly suited to provide toning and exercise the remaining leg muscles used in skating, such as abductors and adductor muscles, the gastrocnemius muscle, the soleusmuscle the gracilis muscle and/or the sartorius muscle.

In an effort to provide an exercise apparatus better adapted to exercise muscles used in skating, U.S. Pat. No. 5,718,658 to Miller et al describes a skate training apparatus which includes a pair of cantilevered support arms which are adapted to support a user's legs in lateral movement. Similarly, U.S. Pat. No. 6,234,935 to Chu describes a skating exercise machine which is adapted to simulate skating movement by the use of a pair of cantilevered supports geared so as to move in an arcuate plane. The exercise apparatus of Chu and Miller, however, suffer the disadvantage in that in their operation, the user's feet are maintained in a generally forward oriented position while moving about a lateral horizontal arc. In contrast, in roller blading or ice skating, an individual typically performs a skating stride whereby the position of each foot during each stride moves so as to turn outwardly, to provide an increased thrust force.

Heretofore, conventional skate training apparatus suffer the further disadvantage in that they are poorly suited to mimic the forward motion achieved in skating movement. In particular, as prior art skating devices are adapted to provide lateral movement substantially in a horizontal plane, conventional skating exercise apparatus fail to account for the change in leg and foot position experienced by a skater during actual forward movement. Furthermore, conventional skating exercise devices which operate to move the user's leg only in a horizontal plane as the user's leg moves outwardly, may result in increased stressing on the user's Achilles and/or fibularis tendons.

Conventional skating exercise devices suffer a further disadvantage in that their complex design makes manufacture difficult, and the cantilevered arrangement of the user supporting pedals may be susceptible to premature wear and failure.

SUMMARY OF THE INVENTION

It is an object of the present invention to provide an exercise apparatus which, in use, permits toning and exercise to a wide variety of leg muscles, including one or more of the biceps femoris muscle, the gracilis muscle, the sartorius muscle, the gastrocnemius muscle and/or the soleus muscle.

Another object of the invention is to provide exercise apparatus which is designed to simulate an athlete's natural ice skating or roller blade movement during forward motion.

Another object of the invention is to provide an exercise apparatus which in use, imparts a lateral and rearward movement to a user's legs, while producing minimal stresses on the Achilles and/or Fibularis tendons.

A further object of the invention is to provide a simplified exercise apparatus which may be easily and economically manufactured, and which in use provides to a user a leg motion which approximates the motion performed by ice skating.

Another object of the invention is to provide a robust exercise apparatus which is adapted to support a user's feet in movement during a natural skating motion.

The present invention provides an exercise apparatus used to simulate skating or roller blading movement in a user. The apparatus includes a pair of sleds or shuttles, each coupled to or including a pedal adapted to support the foot of a user standing thereon in simulated skating movement. The shuttles are movable along a respective guide assembly which, for example, may consist of one or more rails which curve away from each other extending from proximate forwardmost ends, outwardly and rearwardly. More preferably, each of the rail assemblies is provided in a substantially mirror arrangement and curve downwardly from their respective forwardmost ends so as to slope downwardly and rearwardly to a lowermost distal portion. The slope of the rail assemblies may be constant along their length, or alternately may vary in degree between the proximate and distal portions.

A guide member or mechanism may be provided to assist in positioning and/or maintaining the shuttles in sliding movement along each guide assembly, whereby the reciprocal sliding movement of the shuttles along an associated rail assembly acts to guide the feet of the user in skating or roller blade movement. A resistance mechanism may also be provided to enable the user to vary the resistance to which the shuttles move along the rails as, for example, to provide a workout of increased or decreased difficulty.

Accordingly, in one aspect the present invention resides in an exercise apparatus for simulating skating or roller blading movement in a user, said apparatus including,

- a pair of shuttles, each of said shuttles including a frame and for supporting a foot of said user, and a guiding mechanism,
- a pair of guide rail assemblies, each said guide rail assembly extending in a direction away from the other in a substantially mirror arrangement from raised proximal upper ends and curving downwardly and rearwardly to a lower distal end portion,
- each said guiding mechanism guiding said associated shuttle in movement along an associated one of said rail assemblies between the proximal end and distal end portion, and whereby alternating reciprocal movement of said shuttles along said associated rail assemblies moves the feet of a user thereon substantially in skating or roller blading movement.

In another aspect, the present invention resides in an ice skating exercise apparatus comprising,

- at least one pair of guide rails oriented in a substantially mirror arrangement and each extending from a substantially adjacent raised proximal upper end portion and curving downwardly and rearwardly to a lower distal end portion, a pair of shuttles, each for movably supporting a foot of a user thereon and including a frame and a guide assembly for retaining said shuttle in sliding movement along an associated one of said pair of rails between the proximal end portion and the distal end portion, and whereby the sliding movement of said shuttles along said associated pair of rails substantially simulates the user's foot movement during skating.

In a further aspect, the present invention resides in an ice skating or roller blading exercise apparatus, a pair of shuttles, each of said shuttles including a frame for movably supporting a foot of a user therein, and a guiding mechanism, a pair of guide rail assemblies, each said guide rail assembly extending in a direction away from the other from a respective forward proximal end and curving rearwardly to a respective lower distal end portion, each said guiding mechanism guiding said associated shuttle in movement along an associated one of said rail assemblies between the proximal end and distal end portion, and whereby movement of said shuttles along said associated rail assemblies moves the user's feet in simulated skating or roller blading movement.

BRIEF DESCRIPTION OF THE DRAWINGS

Reference is now made to the following detailed description taken together with the accompanying drawings in which.

DETAILED DESCRIPTION OF THE PREFERRED EMBODIMENT

Figure 1:
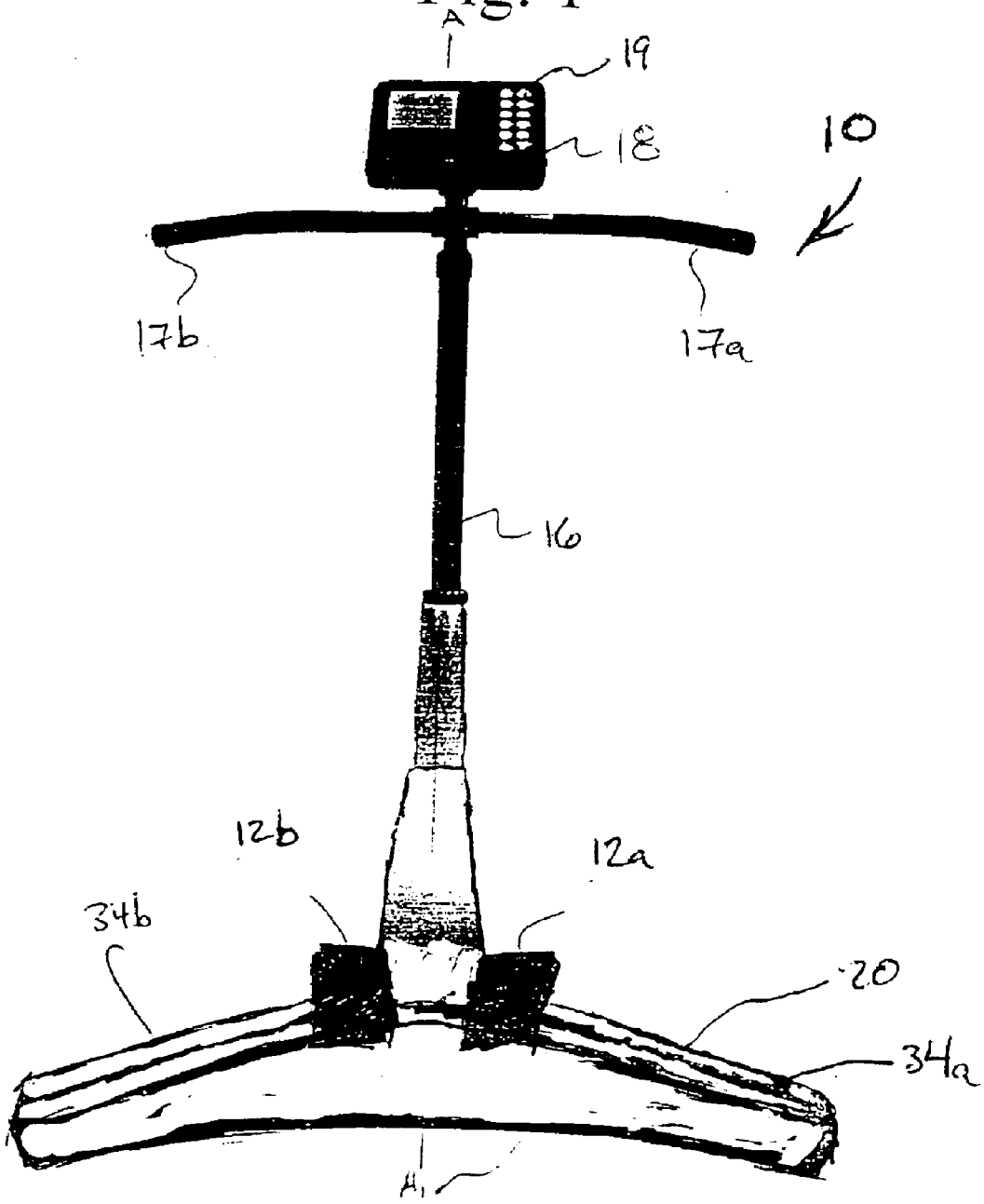
FIGS. 1 and 2 illustrate schematically an exercise apparatus in accordance with a preferred embodiment of the invention.

FIG. 1 illustrates an exercise apparatus 10 which includes a pair of movable pedals 12*a*, 12*b* which, as will be described, are adapted to provide a user 8 (FIG. 2) with an exercise workout which simulates an athlete's movement when ice skating or roller blading. The apparatus 10 is shown as a free standing unit and includes a base 14, a handle assembly 16 and a microprocessor control and display 18. The microprocessor control and display 18 permits the user 8 to select from a variety of stored exercise programs which simulate skating or roller blading workout activities. The control display 18 is mounted to an uppermost end of the handle 16 and in addition to activating a selected exercise program, includes a series of controls 19 which, as will be described, provide signals to vary the tension on the pedals 12*a*, 12*b* and/or select predetermined computerized exercise workouts.

FIG. 1 shows best the apparatus 10 as being substantially symmetrical about a central vertical axis $A–A_1$. The handle assembly 16 includes a pair of fixed laterally extending grips 17*a*,17*b* secured to an upright support adjacent to the control panel 18. The grips 17*a*,17*b* extend laterally outward from the central axis $A–A_1$ of the apparatus 10. It is to be appreciated that the configuration of the grips 17*a*,17*b* is selected so that they may be comfortably grasped by the user 8 to assist in his or her balancing on the exercise apparatus 10 standing in the forward facing position shown in FIG. 2 during its use. In an alternate embodiment, a pair of movable handles (not shown) could be substituted to provide the user 8 with an upper body workout.

Figure 2:
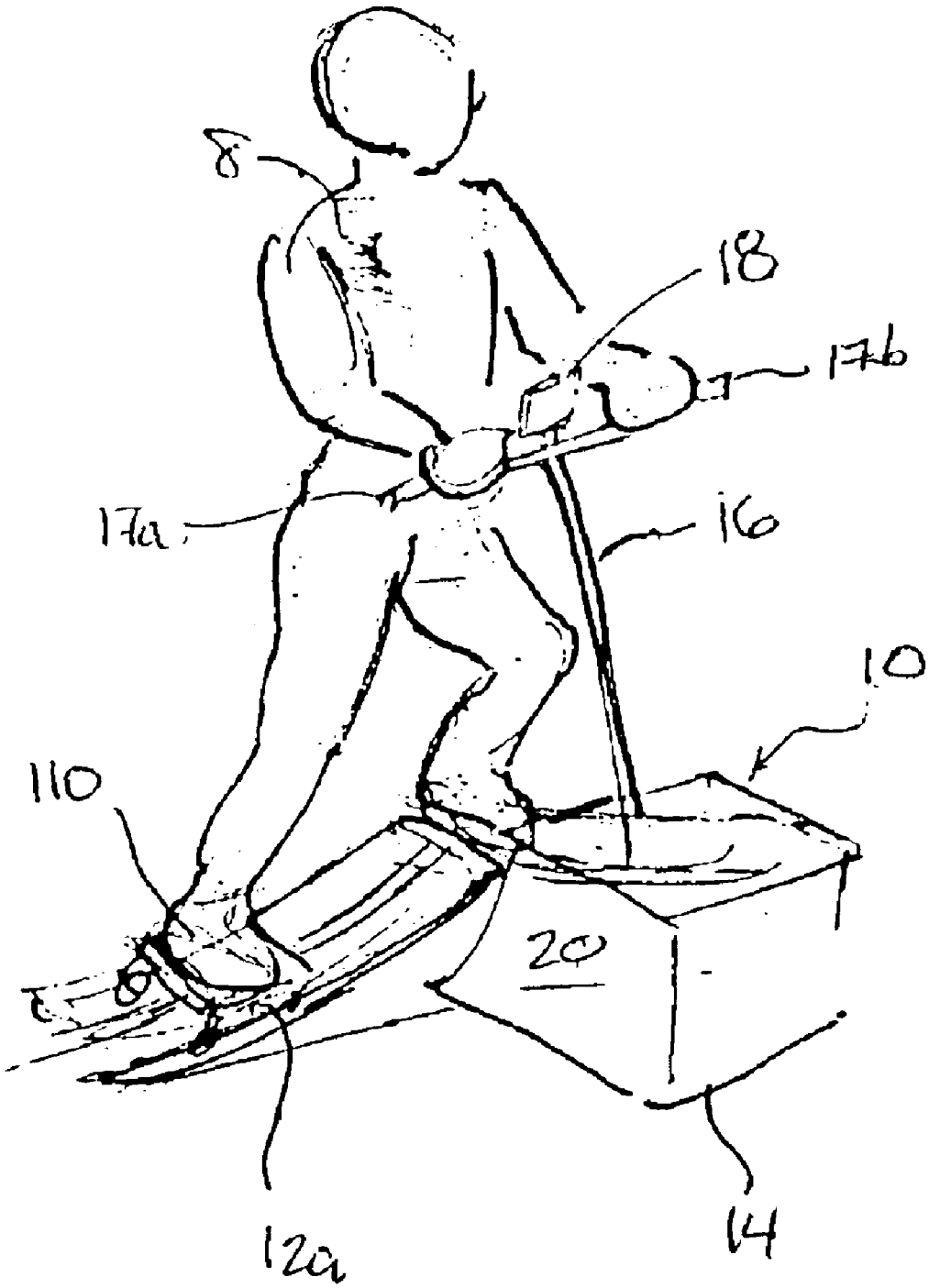
Figure 3:
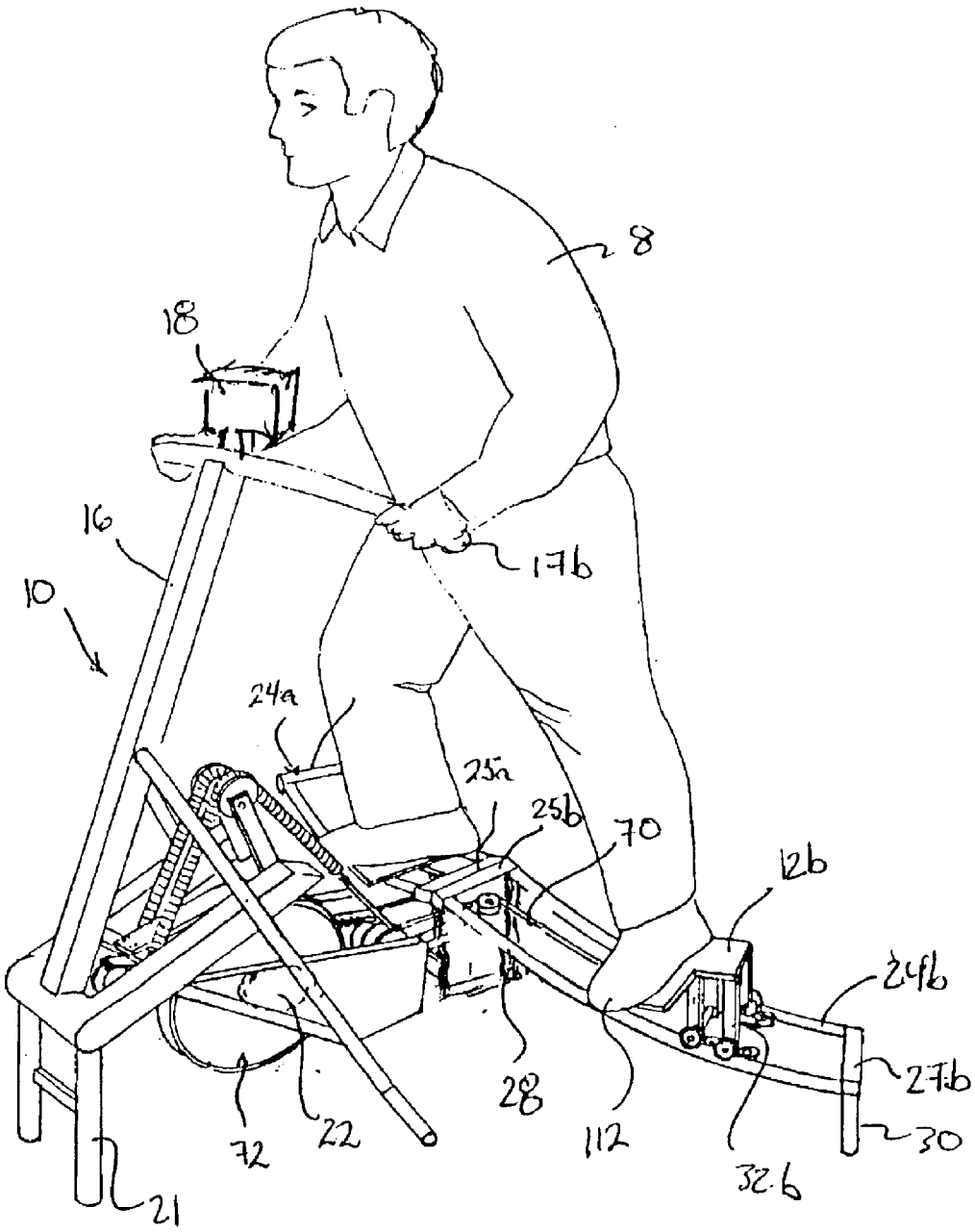
FIGS. 3 and 4 show perspective side views of the apparatus of FIG. 1 with the cowling removed and a user thereon.
Figure 4:
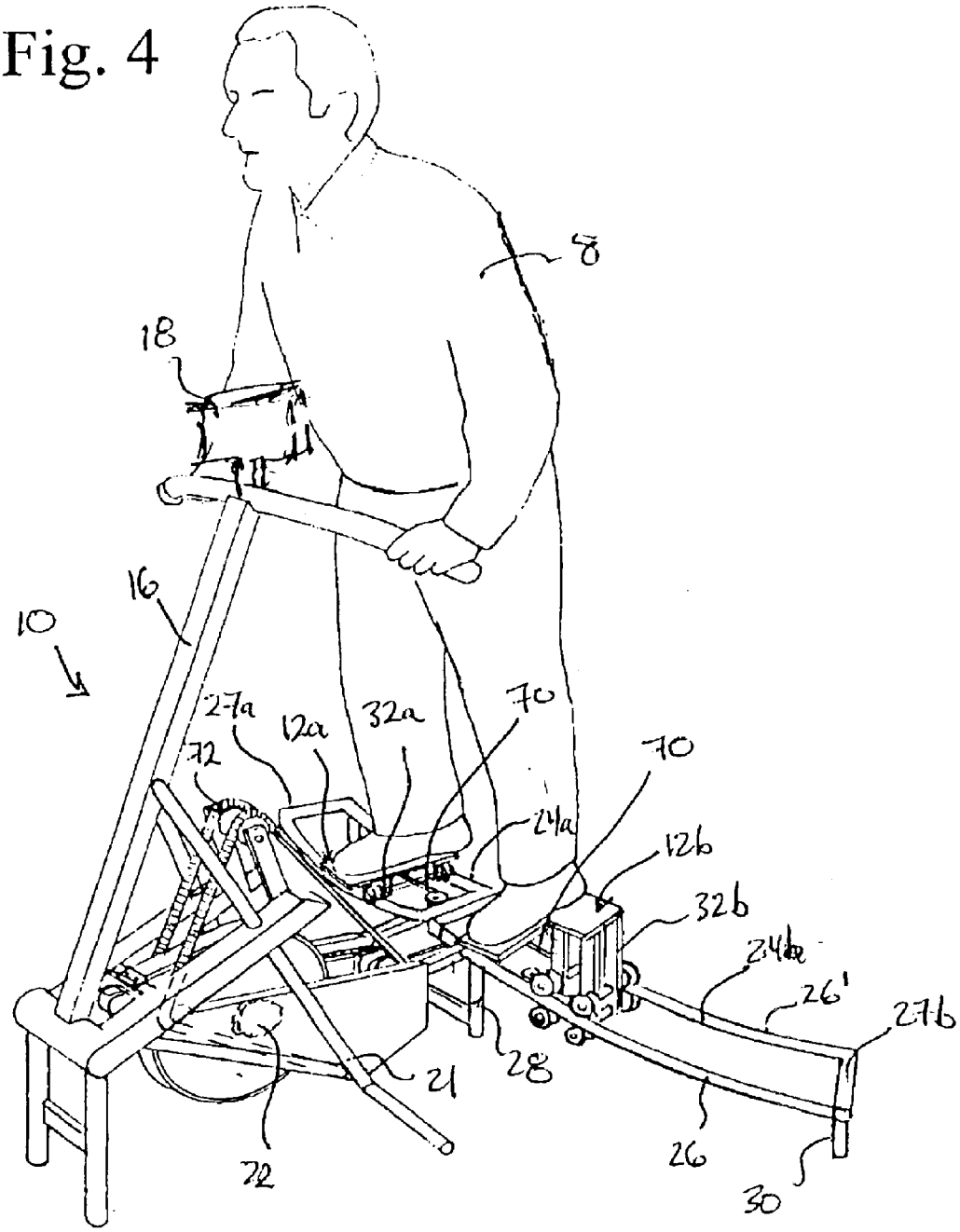

The base 14 has a size selected to provide the apparatus 10 with sufficient stability to support the user 8 thereon in using the apparatus as part of a gym or health club exercise routine. While FIGS. 1 and 2 illustrate the apparatus 10 with a covering cowling 20 in place, and which provides the apparatus 10 with a more aesthetically pleasing appearance, FIGS. 3 and 4 show best the apparatus 10 with the cowling removed for increased clarity. A tubular steel support frame 21, dynamotor 22 and two guide tracks 24*a*,24*b* are housed within the cowling 20 and form part of the base 14.

FIGS. 3, 4, 7 and 8 show the guide tracks 24*a*,24*b* best as each including a pair of parallel spaced, tubular steel rails 26,26'. The rails 26,26' are bent such that each guide track 24*a*,24*b* curves outwardly and rearwardly from respective adjacent proximal ends 25*a*,25*b* to a distal end 27*a*,27*b*. Each of the pairs of rails 26,26' is joined and supported at the proximal inner ends 25*a*,25*b* of each track 24*a*,24*b* by a steel inner vertical support 28, and at their distal ends 27*a*,27*b* by a steel outer vertical support 30. The height of the supports 28 are most preferably selected greater than that of the vertical support 30 such that the guide tracks 24*a*,24*b* each slope downwardly from their proximal ends 25*a*,25*b* towards the distal ends 27*a*,27*b*. Most preferably, the guide tracks 24*a*,24*b* have the identical mirror construction and extend from a mid-axis $A–A_1$ (FIG. 1) of the apparatus 10, curving outwardly therefrom and extending rearwardly downward in opposing directions to the respective distal ends 27*a*,27*b*. As seen best in FIG. 8, although not essential, most preferably the degree of downward curvature of the tracks 24*a*,24*b* gradually decreases in the direction away from the axis $A–A_1$.

The pedals 12*a*, 12*b* are formed as a flat metal plate sized to support, respectively, the right and left feet of the user 8. The pedals 12*a*,12*b* are shown best in FIGS. 4 and 7 as being coupled to a respective shuttle 32*a*,32*b*, and which are each movable along an associated guide track 24*a*,24*b* to provide the user 8 with the desired movement. The pedals 12*a*,12*b* are mounted so as to extend upwardly through a corresponding slit 34*a*,34*b* (FIG. 1) formed in the cowling 20. It is to be appreciated that the slits 34*a*,34*b* have a curvature corresponding to that of the tracks 24*a*,24*b*, so as to permit the substantially unhindered movement of the shuttles 32*a*, 32*b* along each associated track 24*a*,24*b*. Although not essential, straps (not shown) may optionally be provided to assist in maintaining the user's 8 feet in the desired position on the pedals 12*a*,12*b*.

Figure 7:
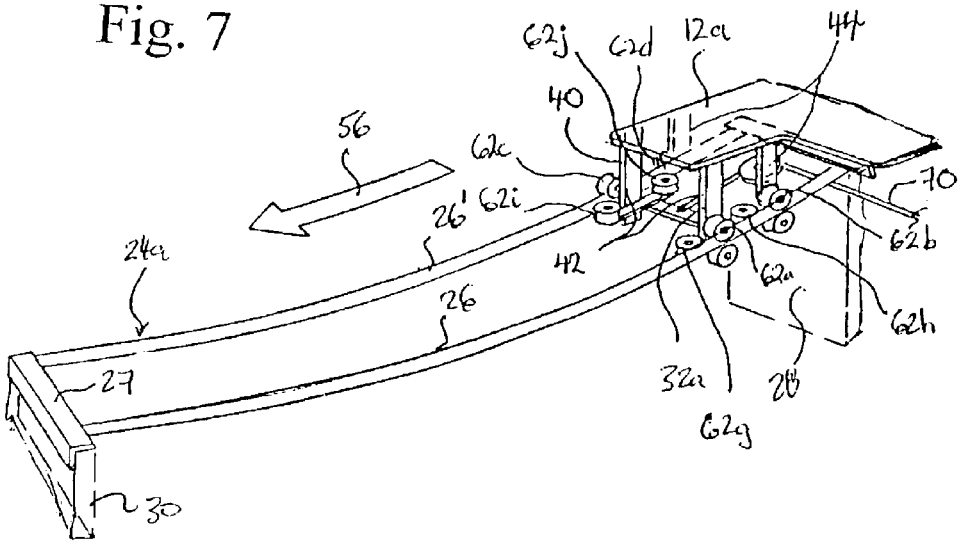
FIG. 7 shows a partial perspective view of the right side of the shuttle and rail assembly of FIG. 3.
Figure 8:
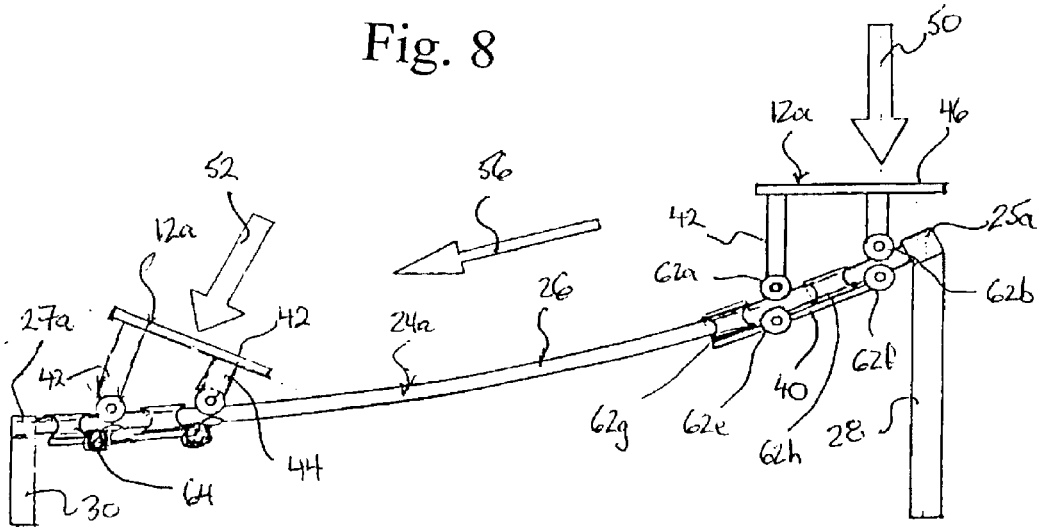
FIG. 8 shows a schematic side view of the shuttle and rail assembly of FIG. 7.

FIGS. 7 and 8 show best the construction of the shuttle 32*a*, the shuttle 32*b* having the identical construction. The shuttles 32 include a metal frame 40 which spans across the respective pair of rails 26,26' forming each track 24*a*,24*b*. The frame 40 includes a pair of distal-most vertical pedal support members 42 which are oriented closest to the distal ends 27*a*,27*b* of the tracks 24*a*,24*b*, respectively, and a pair of proximal-most vertical pedal support members 44 which are spaced closest to the proximal track ends 25*a*,25*b*. As shown best in FIG. 8, the members 42 have a vertical height selected greater than that of the member 44. Most preferably, the height of the members 42 is chosen relative to that of the members 44 such that the pedal 12 supported thereby assumes an orientation with its planar upper surface 46 (FIG. 8) positioned in an orientation inclined at between about 0 and about ±15° relative to the horizontal when the shuttles 32 are moved along the associated tracks 24 to a position substantially adjacent to the proximal end 25 shown by arrow 50. Furthermore, as the shuttles 32 move adjacent to the distal end 27 of each associated guide track 24 to the position shown by arrow 52, the increased height of the pedal support members 42 results in the pedal 12 tilting forwardly so that its upper surface 46 assumes an orientation inclined at between about 15 and 50°, and more preferably about 30°.

It is to be further appreciated that as the frame 40 moves along its associated guide track 24 towards the distal end 27 in the direction of arrow 56, the orientation of the pedals 12*a*,12*b* rotate with the curvature of the rails 26,26', moving from a generally forward orientation when the shuttle 32*a*, 32*b* coupled thereto is spaced adjacent to the proximal end 25, and a position rotated therefrom in a general outward facing orientation when the shuttles 32 are moved to the track distal ends 27.

FIGS. 7 and 8 show best each shuttle 32 as including a number of guide wheels identified generally as 62. The guide wheels 62 are rotatably secured to the frame 40 for rolling movement along the associated guide track 24. Most preferably, the shuttle 32 includes two pairs of load bearing guide wheels 62*a,b* and 62*c,d* (FIG. 7) which engage and roll along an uppermost surface of the associated guide rails 26,26', respectively. One and preferably at least a pair of guide wheels 62*e*,62*f* (FIG. 8) are positioned beneath a corresponding load bearing wheel 62*a*,62*b* of the shuttle 32. The wheels 62*e*,62*f* are located in a position engaging an underside of the guide rail 26 to prevent the shuttle 32 from being raised therefrom. Similarly, pairs of horizontal locating guide wheels 62*g*,62*h*,62*i*,62*j* (FIG. 7) engage the inside facing surfaces of the respective rails 26,26' to prevent the lateral movement of the shuttle 32 from the track 24 and maintain its correct orientation thereon. Although not essential, the guide wheels 62 are most preferably provided with a generally concave peripheral surface 64 (FIG. 8), having an internal curvature corresponding to the circumferential curvature of each tubular rail 26,26'.

Most preferably, each of the shuttles 32*a*,32*b* are independently movable relative to each other against the tension of a return cable 70 (FIG. 3). As shown best in FIGS. 3 to 6, the tensioning cables 70 consist of flexible steel aircraft cable coupled to a tensioning mechanism 72 operating in conjunction with the dynamotor 22. The tensioning mechanism 72 is shown best in FIG. 5 as including a fly wheel 74 which is rotatable about an axle 76, a tensioning strap 78, which is provided in contact with a circumferential periphery of the fly wheel 74, and a caming motor 80. The caming motor 80 is powered by the dynamotor 22 and operates in response to signals received from the controller 18. Through the controller 18, the motor 80 is operated to selectively increase or decrease the friction contact between the tensioning strap 78 and the fly wheel 74, to produce a corresponding increase or decrease in the apparatus resistance.

Figure 5:
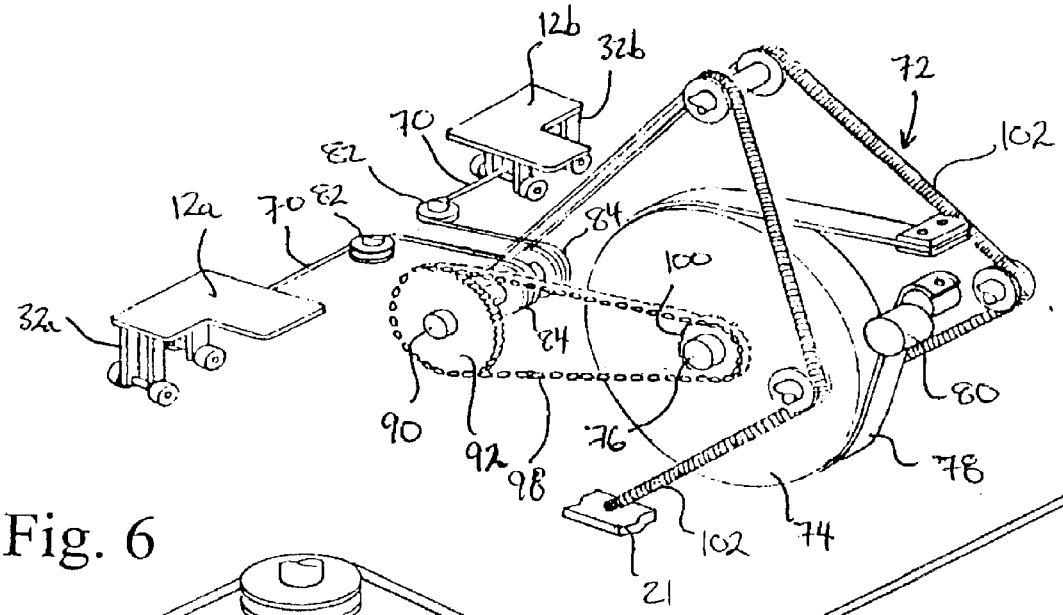
FIG. 5 illustrates schematically the tensioning mechanism and cable pulley arrangement used in the exercise apparatus of FIG. 1.
Figure 6:
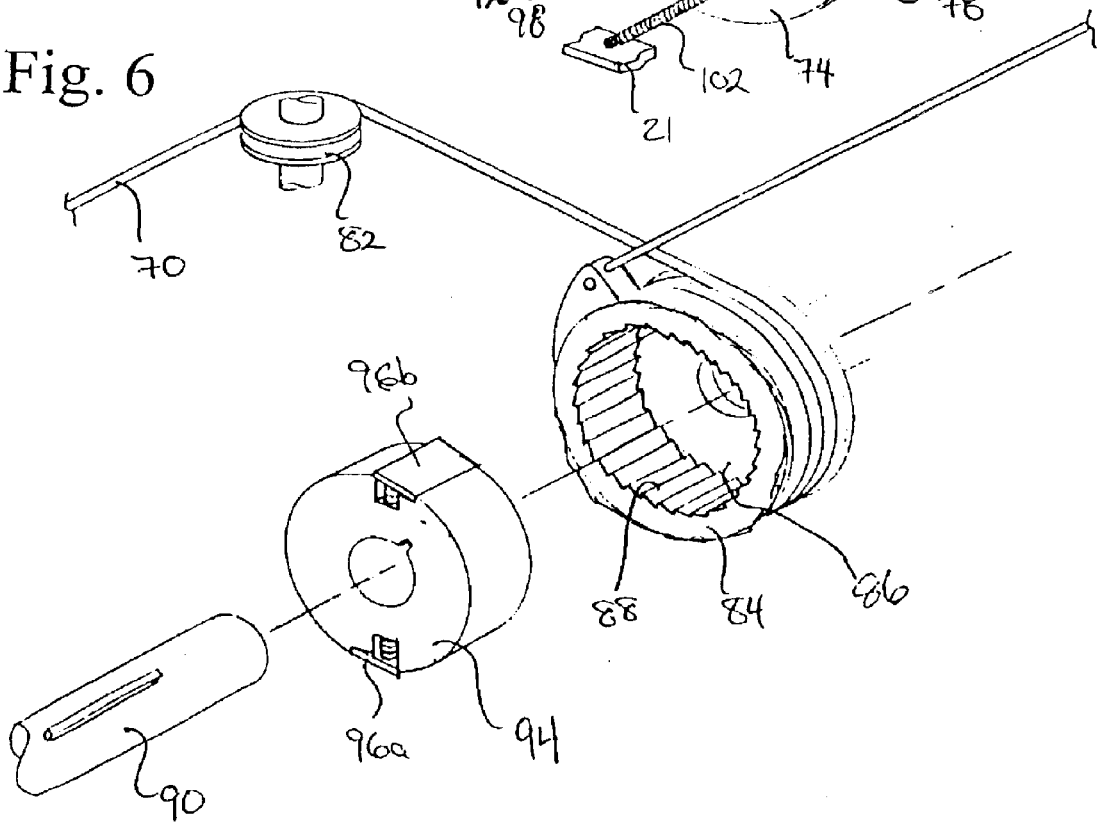
FIG. 6 shows an enlarged partial exploded view of the cable pulley arrangement shown in FIG. 5.

As shown best in FIGS. 5 and 6, each of the tensioning cables 70 are secured at one end to a respective shuttle frame 40 extending about a pulley 82 and being wound about the periphery of an associated cylindrical spool ratchet 84*a*,84*b*. The spool ratchets 84 are each provided with a through opening 86 defined by a radially extending rack 88. The spool ratchets 84*a*,84*b* are journaled for rotation in one common direction about a chain drive axle 90 which has secured at its end a toothed sprocket 92. As shown in FIG. 6, a one-way rotary bushing 94 is secured to the chain drive axle 90 for selective engagement with the rack 88 of each spool 84. The rotary bushings 94 are each provided with a pair of radially opposed spring biased cams 96*a*,96*b* which are adapted to engage the teeth of the rack 88 only in the forward movement of the axle 90 for rotation therewith, while permitting the ratchet spools 84 to rotate relative thereto on return movement in the opposite direction. A drive chain 98 extends about the tooth sprocket 92 and a drive sprocket 100 coupled to the fly wheel axle 96, whereby rotation of the axle 90 and sprocket 92 acts to rotate the fly wheel 74 and provide power to the dynamotor 22.

A pair of elastomeric return cords or shock cords 102 are shown in FIG. 5 as being secured at one end to the apparatus frame 21, and at their other end to an outer periphery of an associated spool ratchet 84. It is to be appreciated that the resiliency of the elastomeric cords 102 act to pull the spool ratchet 84 to a fully returned position, whereby the return cable 70 is wound fully about the periphery of the ratchet 84, resulting in the shuttle 32 coupled thereto moving to a start position adjacent the axis $A–A_1$.

In operation, the user 8 stands on the apparatus 10 grasping the handle grips 17*a*,17*b* with his feet facing forward and resting on the pedals 12*a*,12*b* in the manner shown in FIG. 2. The controller 18 is then activated by the user 8 to select a preprogrammed workout stored therein, whereby the controller 18 will provide a set of program signals to the motor 80 to adjust the pressure applied to the flywheel 74 by the tensioning strap 78.

To initiate the exercise workout, the user 8 pushes outwardly and rearwardly with the right foot 110 (FIG. 2) on the right pedal 12*a* to start skating movement. As the user's foot 110 moves away from the axis $A–A_1$, the shuttle 32*a* travels along the track 24*a* towards its distal end 27*a*. As the pedal 12*a* moves away from the start position adjacent the axis $A–A_1$, its upper surface 46 begins to tilt inwardly and forwardly, pivoting about a horizontal axis, as it travels towards the distal end 27*a* of the track 24*a*. As a result, the user's leg is rotated so that the toes of the user face outwardly with the leg extended rearwardly, without placing significant rotational forces on the user's ankle.

As the shuttle 32*a* moves towards the distal end 27*a* of the track 24*a*, the tensioning cable 70 unwinds from the spool 84 and imparts a rotational force on the spool ratchet 84. In addition to stretching and causing the return cord 102 to wind about the spool ratchet 84, the movement of the spool ratchet 84 results in the engagement of the rack 88 with the cams 96 on the periphery of the rotary bushing 94. The engagement between the cams 96 and rack 88 causes the bushing 94 and axle 90 to rotate with the spool 84 producing a corresponding rotation in the sprocket 92, drive chain 94 and flywheel drive sprocket 100 against the friction of the tensioning strap 78. The rotation of the drive chain 94 operates to rotate the fly wheel 74 about the axle 76 providing additional power to the controlling dynamotor 22.

Following movement of the pedal 26*a* to the distal end 27*a* of track 24*a*, the user 8 shifts his weight onto the left foot 112 (FIG. 3) to move the pedal 12*b* along the track 24*b* towards the distal end 27*b*. It is to be appreciated that the pedal 12*b* travels along the track 24 in the mirror manner to that of pedal 12*a*.

Furthermore, as the user 8 shifts his weight onto pedal 12*b*, the return cable 70 which is coupled to the shuttle 32*a* is wound about spool ratchet 84 associated therewith by the return elasticity of the cord 102. The winding of the cable 70 about the spool 84 draws the shuttle 32*a* in return movement along the track 24*a* to the start position adjacent to the axis $A–A_1$ and proximal end 25*a*. As indicated, with the return movement of the elastomeric cord 102 and the rewinding of the cable 70 about the spool ratchet 84, the ratchet 84 rotates relative to the rotary bushing 94 without the engagement of cams 96 with the rack 88. In this manner, the axle 90 and drive sprocket 100 are driven in only one direction of rotation by the successive engagement of the spool ratchet 84 which is coupled to the return cable 70 secured to each of the two shuttles 32*a*,332*b*.

The skating motion is thus simulated by the apparatus 10 with the user sequentially shifting his or her weight between the pedals 12*a*,12*b*. In addition to more closely simulating a true skating motion, the rotational movement of the pedals 12*a*,12*b* as they move along the guide tracks 24*a*,24*b* optimizes the exercise of the user's 12 leg muscle groups, as the user shifts his weight between the pedals 12*a*,12*b*.

Optionally, the apparatus 10 could be provided with a motorized lift (not shown) which could be selectively activated to raise or lower the proximal ends 25*a*,25*b* of the tracks 24*a*,24*b* at the axis $A–A_1$ relative to their distal end providing a more varied workout. Similarly, the control display 18 could be used to alter the length of maximum movement of the shuttles 32*a*,32*b* along the tracks 24*a*,24*b* to simulate different stride lengths and/or provide either variable or constant tension to the cables 70 as the shuttles 32*a*,32*b* are moved.

Figure 9:
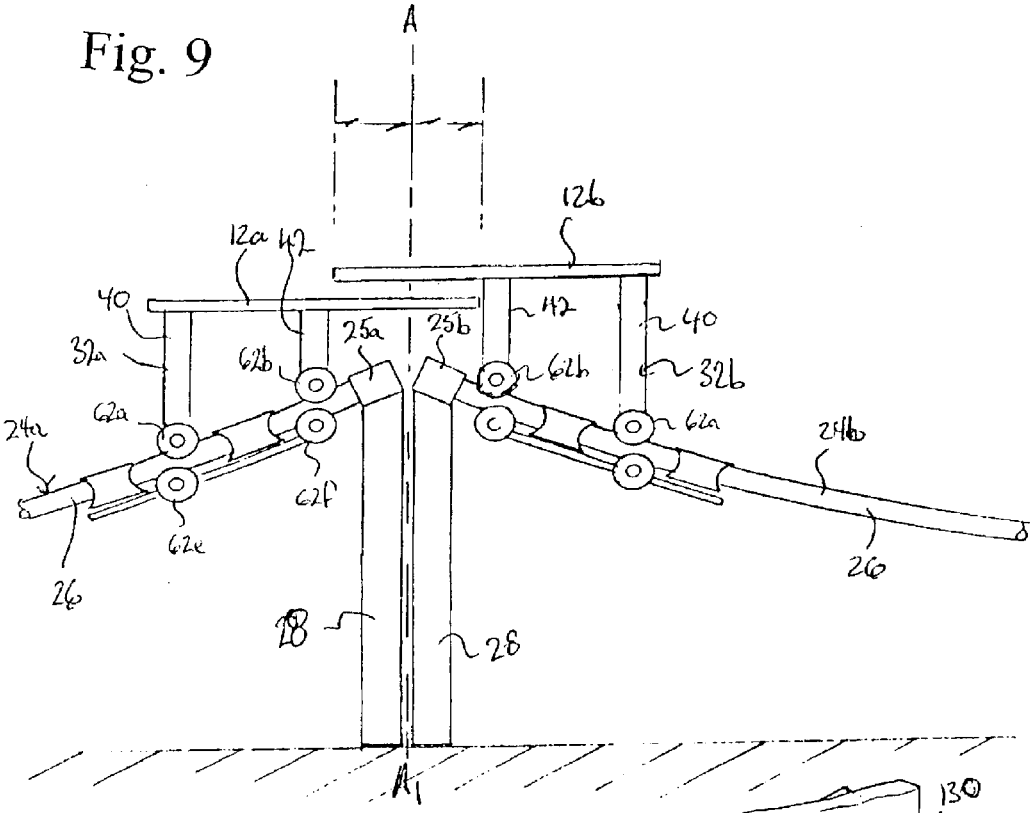
FIG. 9 illustrates schematically a partial front view of the shuttle and rail assembly for use with the apparatus of FIG. 1 in accordance with a second embodiment of the invention.

FIG. 9 shows an alternate possible sled and pedal construction in accordance with a second embodiment of the invention and wherein like reference numerals are used to identify like components. In FIG. 9, the pedals 12*a*,12*b* are mounted to the respective shuttles 32*a*,32*b* in a cantilevered arrangement. In particular, the pedals 12*a*,12*b* are positioned so as to extend inwardly towards each other over the distal-most shuttle supports 42. It is believed that the pedal and shuttle configuration of FIG. 9 is advantageous in that it permits the full return of the pedals 12*a*,12*b* to a position substantially aligned with the axis $A–A_1$. This configuration would advantageously simulate most closely, true skating movement where on skating in forward movement, a user's foot orients directly over the individuals center of mass.

Figure 10:
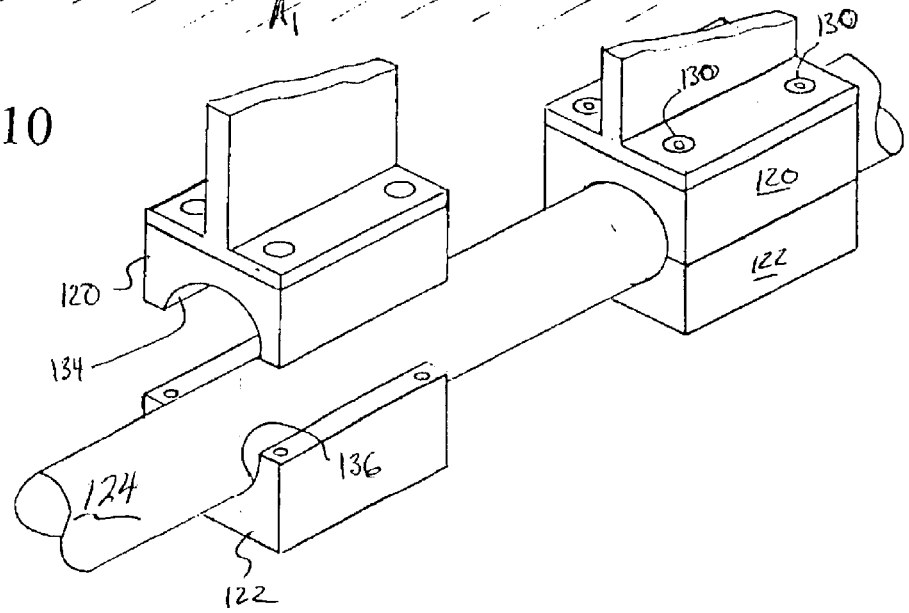
FIG. 10 illustrates an enlarged schematic view of a guide mechanism used in securing a shuttle to a guide rail assembly in accordance with a further embodiment of the invention.

Although the preferred embodiment illustrates the pedals 12*a*,12*b* as being mounted to a wheeled shuttle 32 or trolley which travels along pairs of tubular guide rails 26,26' the invention is not so limited. Similarly, although the detailed description describes the guiding mechanism used to maintain each shuttle 32*a*,32*b* on its associated rail assembly 24*a*,24*b* as comprising a series of spaced guide wheels 62, other guide assemblies including, without restriction, the use of dovetail slide bearings, ball bearings, or the like, could also be used without departing from the spirit and scope of the invention. Other shuttle arrangements and guide configurations are also possible and will now become apparent. Reference may be had to FIG. 10 which illustrates one possible alternate shuttle guide assembly. In FIG. 10, two pairs of slide bushings 120,122 are provided in place of the offset wheel construction shown in FIG. 3. The slide bushings 120,122 are adapted to engage a single tubular steel rail 124 in longitudinal sliding movement therealong. The bushings 120,122 are secured to each other by a series of threaded screws 130 and are further provided with a curved slide surface 134,136, respectively, having a profile selected complementary to the radius of curvature of the rail 124.

While the Figures illustrate the use of cables 70 to provide independent return movement of the shuttles 36, the invention is not so limited. Chains or belts could be substituted for the cables 70 with adjustments made to the pulley arrangement. In a more economical construction, the shuttles 36 could be connected to each other for dependent movement, or alternately, the use of cables to provide return movement could be omitted in their entirety.

While the preferred embodiment of the invention discloses the tensioning mechanism as comprising a flywheel 74 and adjustable tensioning strap 78, it is to be appreciated that other tensioning devices could also be used, including without restriction, weights or pressure stacks, fan resistant mechanisms and electromagnetic resistance mechanisms.

Although the detailed description of the invention describes the shuttle frame 40 as configured to incline in a forward direction as the shuttles 32 move rearwardly along the tracks 24, the invention is not so limited. The shuttles 32 could include a platform which is maintained at a relatively constant angle relative to the horizontal as the shuttle 32 moves. Alternate shuttle frame configurations could also be used.

Similarly, while the use of elastomeric shock or bungee cords 102 are described as assisting in the return movement of the shuttles 32 and pedals 12 to the initial starting position, the shock cords 102 could be omitted in their entirety and the shuttles 32 moved in return movement through the exertions of the user 8 alone. Alternately, other return mechanisms, including, without limitation, resiliently extendable springs, could also be employed.

Although the Figures illustrate an exercise apparatus 10 in which the shuttles 32*a*,32*b* move along a respective rail assembly 24*a*,24*b*, which each comprise a pair of parallel curved rails 26,26', the rail assemblies 24 could each consist of either a single rail or three or more rails configured to guide a shuttle 32 associated therewith in the desired degree of arcuate movement.

While the detailed description describes and illustrates the tracks 24*a*,24*b* as sloping downwardly rearward towards their respective distal ends 27*a*,27*b*, other track configurations are also possible For example, the tracks 24*a*,24*b* could be formed either substantially flat, or in an alternate construction, could curve in the opposite manner, each bending upwardly from the proximal end 25*a*,25*b* to their distal ends 27*a*,27*b*.

Although the detailed description describes and illustrates a preferred apparatus construction, the invention is not so limited. Many variations and modifications will now appear to persons skilled in the art. For a definition of the invention reference may be had to the appended claims.

I claim:

1. An exercise apparatus for simulating skating or roller blading movement in a user, said apparatus including, a pair of shuttles, each of said shuttles including a frame for supporting a foot of said user standing in a generally forward facing position thereon, and a guiding mechanism, a pair of guide rail assemblies, each said guide rail assembly extending in a direction away from the other in a substantially mirror arrangement from raised proximal upper ends and continuously curving downwardly and/or rearwardly to a lower distal end portion, each said guiding mechanism guiding said associated shuttle in movement along an associated one of said rail assemblies between the proximal end and distal end portion, and whereby alternating reciprocal movement of said shuttles along said associated rail assemblies moves the feet of a user thereon substantially in skating or roller blading movement.

2. The exercise apparatus of claim 1 wherein each said rail assembly comprises a pair of substantially parallel spaced rails, and each said guiding mechanism further includes at least one pair of wheels rotatably engaging at least one of said rails of said associated rail assembly for rolling movement therealong.

3. The exercise apparatus of claim 1 further including a return device for biasing the shuttles to an initial starting position spaced towards the proximal end of said associated rail assembly.

4. The exercise apparatus of claim 3 wherein said return device is selected from a resiliently extendable spring and a resiliently extendable shock cord.

5. The exercise apparatus of claim 1 further including a tensioning mechanism selectively operable to permit said user to vary resistance to the movement of said shuttles in at least one direction along said associated rail assembly.

6. The exercise apparatus of claim 5 wherein said tensioning mechanism includes, a flywheel, a pair of elongated drive cables, a first end portion of each of said cables being coupled to a corresponding one of said shuttles, and linked at the other second end portion to provide rotational energy to said flywheel when said shuttle is moved towards the distal end of the rail assembly associated therewith, a tensioning strap engaging said flywheel, and an adjustment mechanism for increasing or decreasing contact pressure between the strap and the flywheel, whereby adjustment of the contact pressure of said strap against said flywheel produces a corresponding increase or decrease in the resistance to shuttle movement.

7. The exercise apparatus of claim 1 further including a pair of pedals, each of said pedals comprising a generally planar plate being mounted to a respective shuttle frame and sized to support one of said user's feet thereon, the frame including a proximal support spaced towards said proximal end of said associated rail assembly, and supporting a proximate-most portion of said plate, and a distal support spaced towards said distal end portion of said associated rail assembly and supporting a distal-most portion of said plate, and wherein said distal support extends from said associated rail assembly a height selected generally greater than that of said proximal support.

8. The exercise apparatus of claim 7 wherein said proximal end distal supports extend a height above said associated rail assembly by a distance selected so that said plate assumes an orientation inclined relative to the horizontal at between 0 and ±15° when the shuttle is moved to a position substantially adjacent to the proximal end.

9. The exercise apparatus of claim 7 further including a return device for biasing the shuttles to an initial starling position spaced towards the proximal end of said associated rail assembly.

10. The exercise apparatus of claim 8 further including a tensioning mechanism selectively operable by said user to vary resistance to the movement of said shuttles in at least one direction along said associated rail assembly.

11. An ice skating exercise apparatus comprising, at least one pair of elongated guide assemblies oriented in a substantially mirror arrangement and each extending in a direction away from the other from a substantially adjacent raised proximal upper end portion and curving downwardly and rearwardly to a lower distal end portion, a pair of shuttles, each for movably supporting a foot of a user standing in a generally forward facing position thereon and including a frame and a guide mechanism for limiting said shuttle in sliding movement along an associated one of said guide assemblies between the proximal end portion and the distal end portion, and whereby the sliding movement of said shuttles along said associated guide assembly substantially simulates the user's foot movement during skating.

12. The exercise apparatus of claim 11 further including a return device for biasing the shuttles to an initial starting position adjacent the proximal end portion of said associated guide assembly.

13. The exercise apparatus of claim 11 wherein said return device is selected from a resiliently extendable spring and a resiliently extendable shock cord.

14. The exercise apparatus of claim 11 further including a tensioning mechanism operable to permit said user to vary resistance to the movement of said shuttles in at least one direction along said associated guide assembly.

15. The exercise apparatus of claim ii wherein each said shuttle further comprises, a generally planar plate mounted to said frame and sized to support one of said user's feet with said user standing thereon, said frame including a proximal plate support spaced closest towards said proximal end portion of said associated guide assembly, and a distal support spaced closest towards said distal end portion of said associated guide assembly, said distal plate support extending vertically above said associated guide assembly a distance greater than said proximal plate support whereby said plate is inclined forwardly as said shuttle moves along the associated guide assembly from the proximal end portion towards the distal end portion.

16. The exercise apparatus of claim 15 wherein said proximal plate support and said distal plate support extend a height above said associated guide assembly by a distance selected so that said plate assumes an orientation inclined at between 0 and 15° when the shuttle is located adjacent to the proximal end portion.

17. An ice skating or roller blading exercise apparatus, a pair of shuttles, each of said shuttles including a frame for movably supporting a foot of user standing in a generally forward facing position thereon, and a guiding mechanism, a pair of guide rail assemblies, each said guide rail assembly extending in a direction away from the other from a respective forward proximal end and curving rearwardly to a respective lower distal end portion, each said guiding mechanism limiting said associated shuttle in reciprocal movement along an associated one of said rail assemblies between the proximal end and distal end portion, and whereby movement of said shuttles along said associated rail assemblies moves the user's feet in simulated skating or roller blading movement.

18. The exercise apparatus of claim 17 wherein each said rail assembly comprises a pair of substantially parallel spaced rails which curve downwardly rearward from the proximal end towards the distal end portion, the apparatus further including a return device for biasing the shuttles to an initial starting position spaced towards the proximal end of said associated rail assembly, and a tensioning mechanism selectively operable to permit said user to vary resistance to the movement of said shuttles towards the distal end portion.

19. The exercise apparatus of claim 17 wherein each of said shuttles further comprise, a generally planar plate mounted to said frame and sized to support one of said user's feet thereon, the frame including a proximal support spared towards said proximal end of said associated rail assembly, and supporting a proximate-most portion of said plate, and a distal support spaced towards said distal end portion of said associated rail assembly and supporting a distal-most portion of said plate, and wherein said distal support extends from said associated rail assembly a height selected generally greater than that of said proximal support.

20. The exercise apparatus of claim 18 wherein each of said shuttles further comprise, a pedal comprising generally planar plate mounted to said frame and sized to support one of said user's feet thereon, the frame including a proximal support spaced towards said proximal end of said associated rail assembly, and supporting a proximate-most portion of said plate, and a distal support spaced towards said distal end portion of said associated rail assembly and supporting a distal-most portion of said plate, said distal support extending from said associated rail assembly a height selected generally greater than that of said proximal support, and wherein said proximal and distal support extends a height above said associated rail assembly by a distance selected so that said plate assumes an orientation inclined relative to the horizontal at between 0 and 15° when the shuttle is moved to a position adjacent to the proximal end portion, and inclined at between about 15 and 50° when the shuttle is moved to the distal end portion.

* * * * *